US008231391B2

(12) United States Patent
Boecker

(10) Patent No.: US 8,231,391 B2
(45) Date of Patent: Jul. 31, 2012

(54) METAL PROTECTIVE GROUND CONDUCTOR CONNECTION DEVICE

(75) Inventor: Marc Boecker, Steinheim (DE)

(73) Assignee: Weidmueller Interface GmbH & Co. KG, Detmold (DE)

( * ) Notice: Subject to any disclaimer, the term of this patent is extended or adjusted under 35 U.S.C. 154(b) by 71 days.

(21) Appl. No.: 12/995,443

(22) PCT Filed: Jun. 8, 2009

(86) PCT No.: PCT/EP2009/057018

§ 371 (c)(1),
(2), (4) Date: Nov. 30, 2010

(87) PCT Pub. No.: WO2009/156262

PCT Pub. Date: Dec. 30, 2009

(65) Prior Publication Data

US 2011/0070755 A1 Mar. 24, 2011

(30) Foreign Application Priority Data

Jun. 27, 2008 (DE) ..... 202008008656

(51) Int. Cl.
*H01R 13/648* (2006.01)
*H01R 4/66* (2006.01)

(52) U.S. Cl. ..... 439/94

(58) Field of Classification Search ..... 439/121, 439/716, 532, 92, 94, 95, 110, 114
See application file for complete search history.

(56) References Cited

U.S. PATENT DOCUMENTS

| | | | | |
|---|---|---|---|---|
| 5,934,916 | A * | 8/1999 | Latal et al. | 439/95 |
| 6,293,820 | B1 * | 9/2001 | Bechaz et al. | 439/532 |
| 6,454,614 | B1 * | 9/2002 | Bechaz et al. | 439/716 |

FOREIGN PATENT DOCUMENTS

| | | | |
|---|---|---|---|
| DE | 2914182 | A1 | 10/1980 |
| DE | 3526494 | A1 | 1/1987 |
| DE | 4409206 | C1 | 5/1995 |
| DE | 19818704 | C1 | 11/1999 |
| EP | 0364745 | A | 4/1990 |
| EP | 1085628 | A1 | 3/2001 |
| EP | 1182735 | | 5/2005 |

* cited by examiner

*Primary Examiner* — Javaid Nasri
(74) *Attorney, Agent, or Firm* — Lawrence E. Laubscher, Sr.; Lawrence E. Laubscher, Jr.

(57) ABSTRACT

A ground conductor includes a conductor body formed from a sheet of conductive metal material of a given thickness, the conductor body having a horizontal base portion, and a pair of downwardly extending vertical leg portions that contain opposed mounting rail cavities that terminate at one end in a pair of flange recesses. A vertical tongue portion extends downwardly from the conductor body transversely across the leg portions at the other end of the cavities, the tongue portion having a width that is greater than the thickness of the metal sheet. When the conductor body is mounted on the mounting rail with one flange extending within the recesses, a spring biases the conductor body in a direction to effect electrical engagement between the other rail flange portion and the adjacent surface of the tongue portion.

7 Claims, 6 Drawing Sheets

METAL PROTECTIVE GROUND CONDUCTOR CONNECTION DEVICE

REFERENCE TO RELATED APPLICATIONS

This application is a continuation of International Application No. PCT/EP2009/057018 filed Jun. 8, 2009, which claims priority of German Application No. 20 2008 008 656.6 filed Jun. 27, 2008.

BACKGROUND OF THE INVENTION

1. Field of the Invention

A ground conductor includes a conductor body formed from a sheet of conductive metal material of a given thickness, the conductor body having a horizontal base portion, and a pair of downwardly extending vertical leg portions that contain opposed mounting rail cavities that terminate at one end in a pair of flange recesses. A vertical tongue portion extends downwardly from the conductor body transversely across the leg portions at the other end of the cavities, the tongue portion having a width that is greater than the thickness of the metal sheet. When the conductor body is mounted on the mounting rail with one flange extending within the recesses, a spring biases the conductor body in a direction to effect electrical engagement between the other rail flange portion and the adjacent surface of the tongue portion.

2. Description of Related Art

Grounded conductor wire connection devices are used in various electrical devices, especially in terminal blocks that can be snapped on mounting rails or in electronic housings of some other kind, for example, in switchboards of machines, in order to establish a connection to the mounting rail. The transition resistance to the mounting rail is to be as low as possible, and in case of an error, it should be possible to guarantee a high current conduction.

An example of a typical grounded conductor wire connection device is described in the Follmann et al European patent No. EP 1 182 735 B1, wherein the grounded conductor connection device consists of a sheet metal part with a U-shaped seat for a mounting rail. By way of another feature, it is provided here that only a relatively small cross-section is available for the current conduction of the grounded conductor wire.

SUMMARY OF THE INVENTION

Accordingly, a primary object of the present invention is to provide a ground conductor formed of a conductive metal sheet, the conductor body having a horizontal base portion, and a pair of downwardly extending vertical leg portions that contain opposed mounting rail cavities that terminate at one end in a pair of flange recesses. A vertical tongue portion extends downwardly from the conductor body transversely across the leg portions at the other end of the cavities, the tongue portion having a width that is greater than the thickness of the metal sheet. When the conductor body is mounted on the mounting rail with one flange extending within the recesses, spring means bias the conductor body in a direction to effect electrical engagement between the other rail flange portion and the adjacent surface of the tongue portion.

According to another object of the invention, the spring means comprises a leaf spring mounted between the conductor leg portions, said leaf spring being maintained in a compressed condition with a portion thereof extending adjacent the pair of flange recesses for engagement with the adjacent extremity of the associated mounting rail flange portion, thereby bias the conductor in a direction relative to the rail to effect surface to surface electrical engagement between the extremity of the other rail flange and the tongue portion of the conductor.

A further object of the invention is to provide the ground conductor with a bus bar for connection with the various circuits of the associated electrical component.

According to a more specific object, the basic ground conductor body has a contact tongue—with a line contact area directed toward the mounting rail—which is wider than the material thickness of the conducting material and/or which, in a direction normal to the main longitudinal axis of the mounting rail, has at least the width of the base segment. As a result, one can considerably reduce the danger of a material burn at high current intensities because a large current transmission cross-section is produced that is suitable for high pulse currents. For example, one can transmit brief currents of up to 20 kA.

Another mechanical advantage derives from the fact that, first of all, there is a greater strength due to the U-shaped cross-section of the conductor body, and, besides, more material is available for wear and tear.

In a preferred embodiment, the basic body is made in an easily producible fashion as a flexible stamping part. At the same time, it is advantageous that the contact tongue can be integral with the conductor, which tongue is punched out of the material of the basic body and which is bent over to the desired position.

Another advantage results in the fact that the contact tongue is retained in a stabilized manner between the leg portions of the conductor, as a result of which, the strength of the U-shaped basic body is increased.

In another preferred embodiment, the spring between the leg portions and parts of the basic segment of the basic body is retained in a pre-stressed manner, whereby the necessary retaining segments can be made simultaneously during the punching-bending procedure.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1:
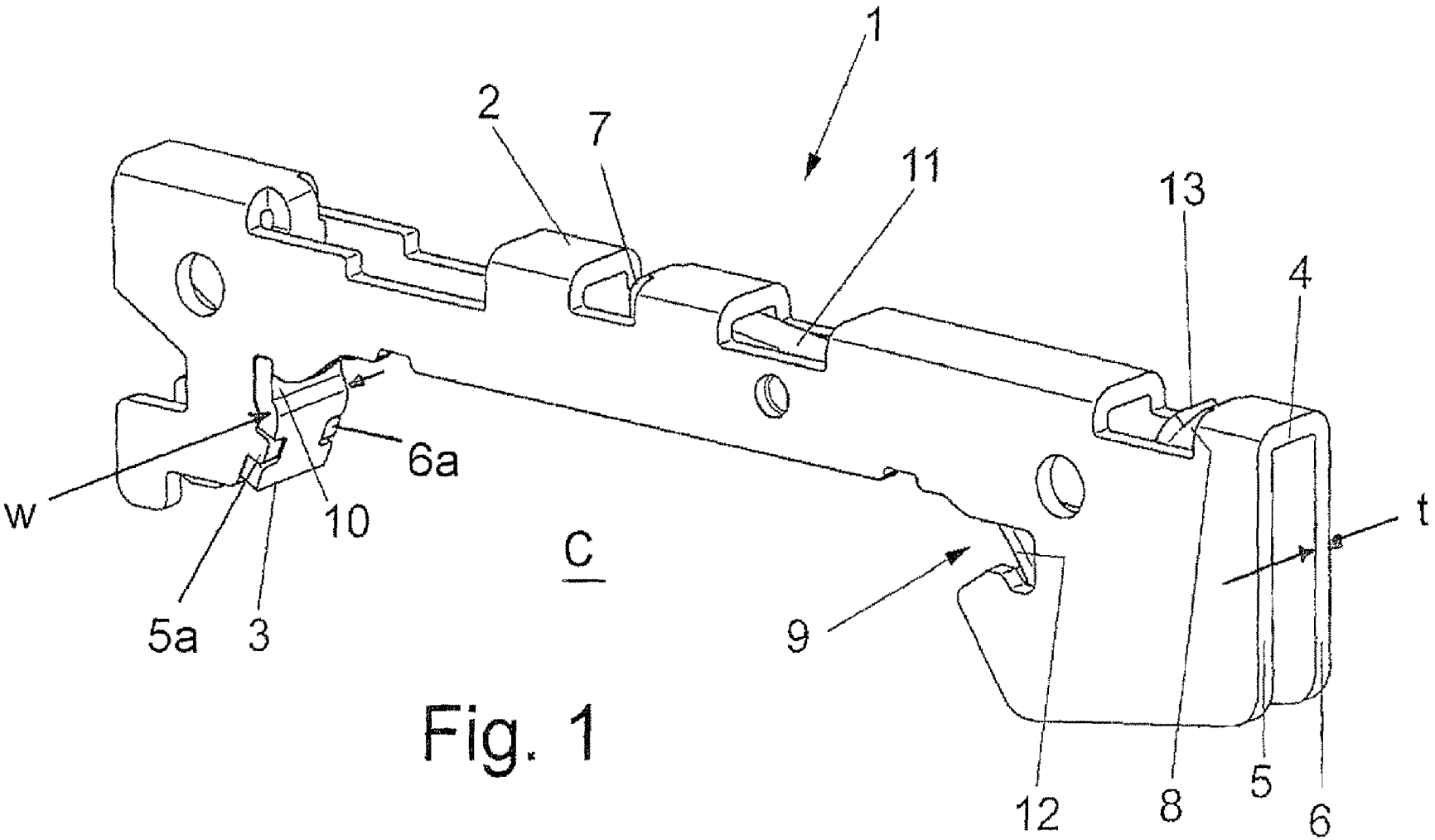
FIG. 1 is a perspective side view of the ground conductor of the present invention.

Referring first more particularly to FIG. 1, the ground conductor 1 of the present invention comprises a ground conductor body 2 that is formed by punching and stamping from a metal conductive sheet material, thereby to define an inverted generally U-shaped configuration, said body including a horizontal base portion 4, and a pair of downwardly extending parallel spaced vertical leg portions 5 and 6. As will be described in greater detail below, the conductor body also includes an integral downwardly-extending conductive tongue portion 3 that is formed by punching and bending from the base portion 4.

The lower edge portions of the body leg portions 5 and 6 contain opposed rail-receiving cavities C that terminate at their first ends in flange-receiving recesses 9. At their other ends 9', the cavities terminate in end walls that support the downwardly bent tongue portion 3. Stabilizing tabs 5*a* and 6*a* extend from the cavity end walls into corresponding slots contained in the tongue portion 3. It is important to note that the width w of the tongue portion 3 is greater than the thickness t of the metal sheet from which the conductor body 2 is formed.

Figure 2:
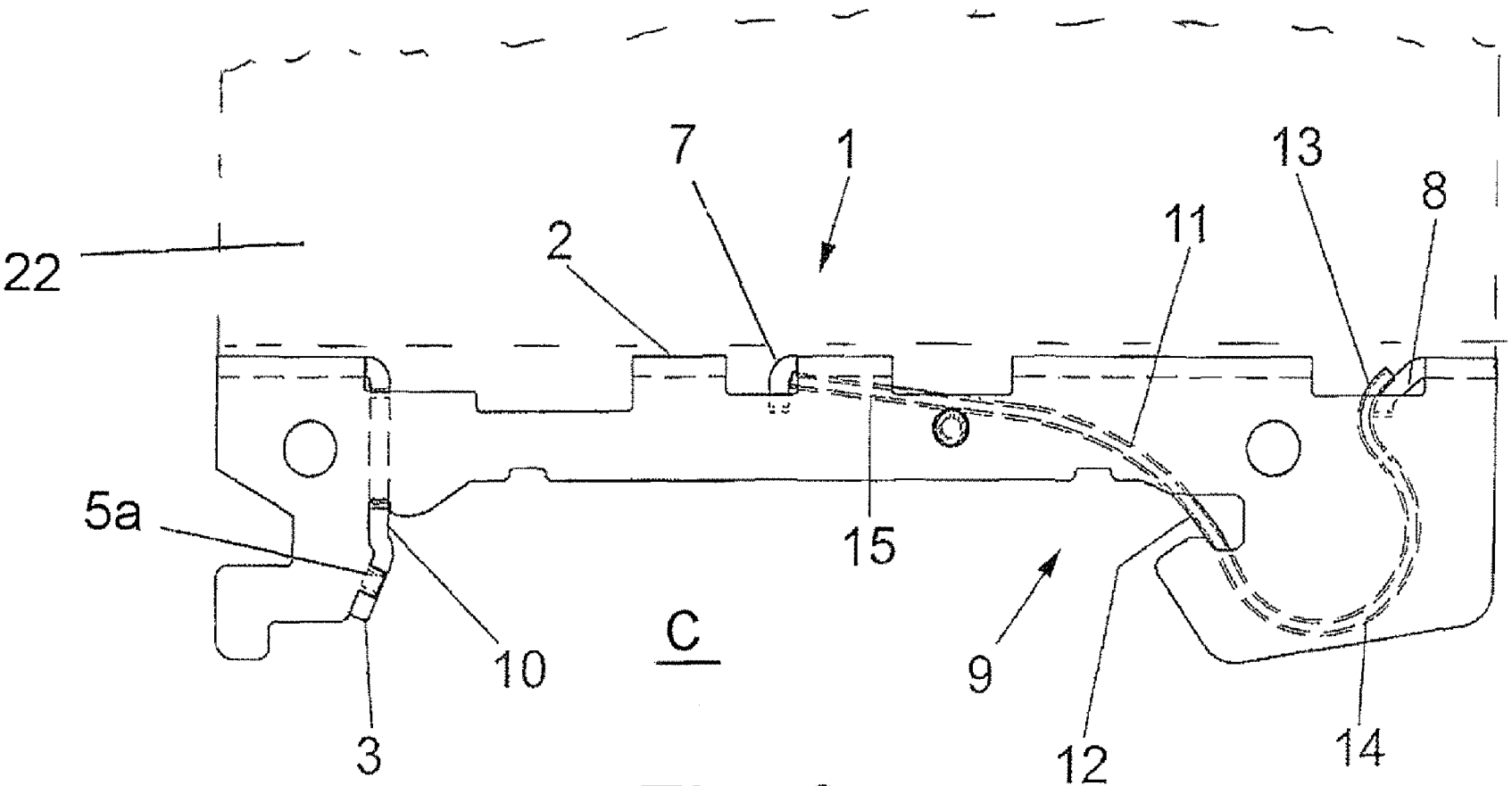
FIG. 2 is a side elevation view of the ground conductor of FIG. 1.

As best shown in FIG. 2, a leaf spring 11 is mounted in a compressed condition between the body leg portions 5 and 6, said leaf spring having end portions 13 and 15 that are retained relative to the conductor body by integral downwardly-bent retaining tab portions 7 and 8. The leaf spring includes a downwardly extending intermediate portion 11, and a reversely-bent semi-circular portion 14, said spring having a configuration such that a contact portion 12 thereof extends between the flange recesses 9.

An electrical component 22, such as a terminal block, relay or the like, is supported by the conductor body 2.

Figure 3:
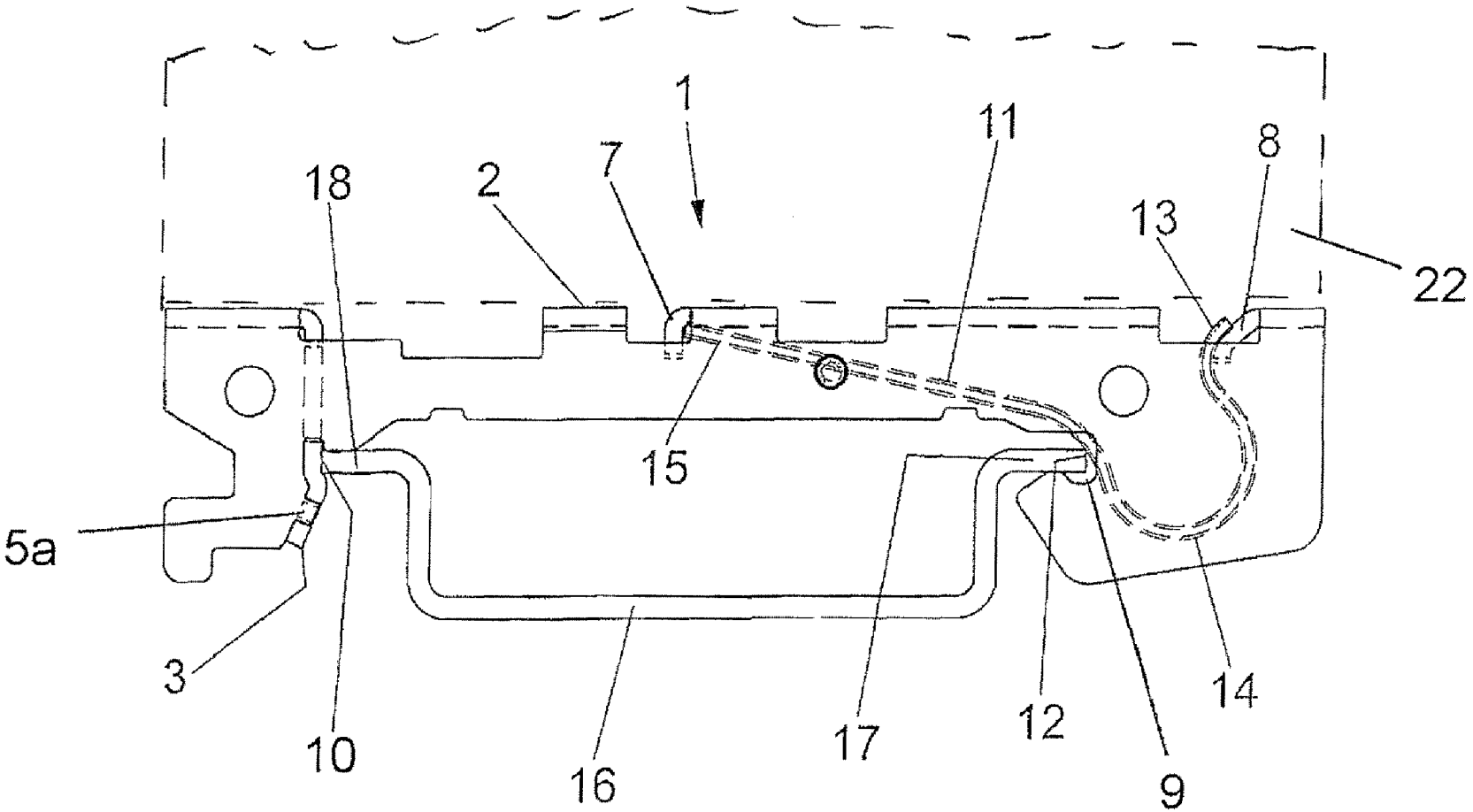
FIGS. 3 and 4 are a side elevation and partly sectioned views, respectively, of the ground conductor mounted on a mounting rail.
Figure 4:
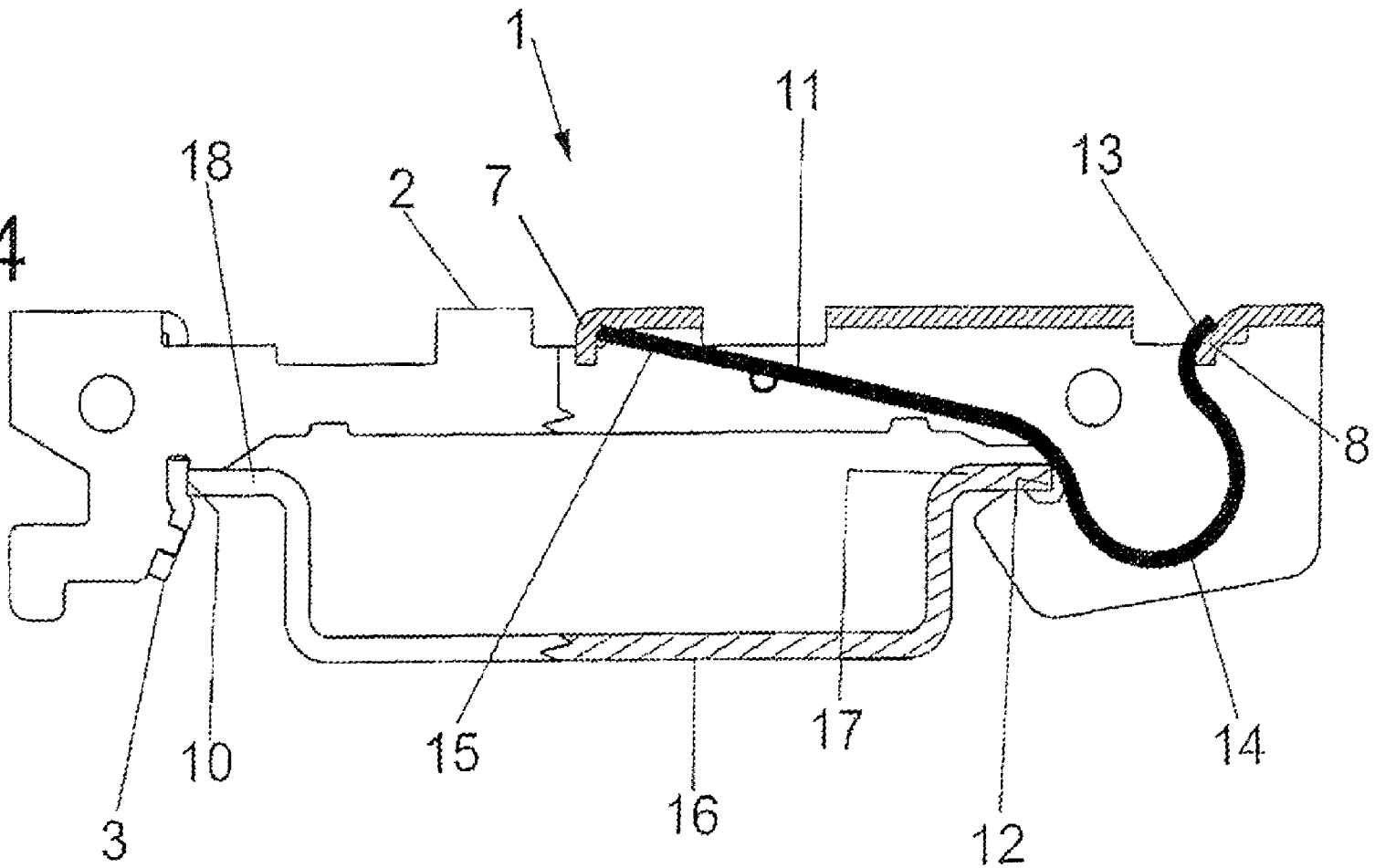
Figure 5:
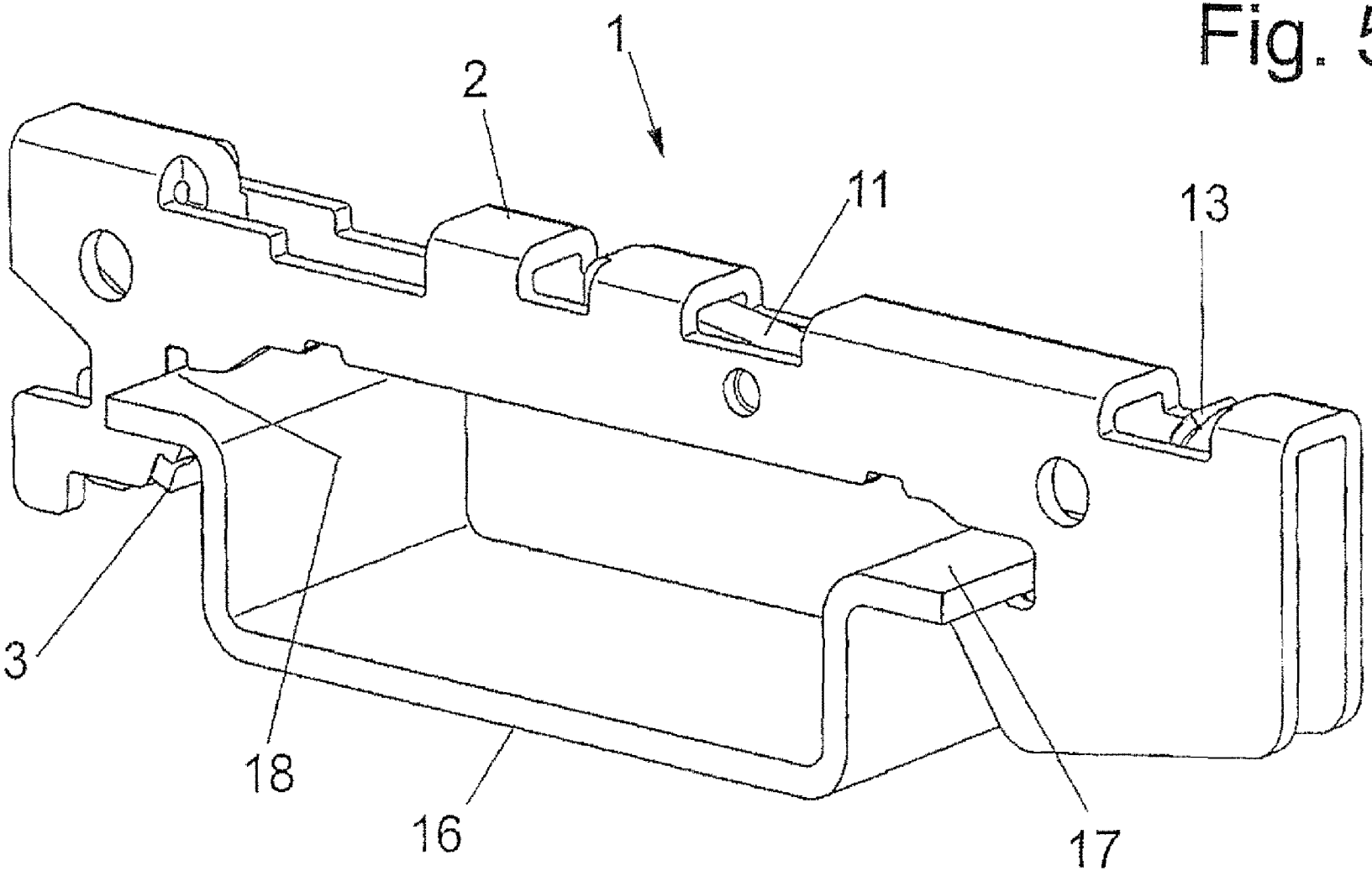
FIG. 5 is a corresponding perspective view of the apparatus of FIG. 3.

Referring now to FIGS. 3-5, the conductor body 2 is adapted for mounting transversely across a support rail 16 of the so-called top hat type including outwardly directed flange portions 17 and 18. The flange portion 17 extends into the two flange recesses 9 at the right hand ends of the cavities C, and the edge extremity of the flange portion 18 terminates adjacent the contact surface 10 of the tongue portion 3. The portion 12 of leaf spring 11 engages the right hand extremity of the mounting rail flange 17 to bias the conductor body 2 to the right relative to the rail 16, thereby to effect a tight electrical engagement between the tongue surface 10 and the adjacent edge of flange 18. Owing to the increased width w of the tongue 3, a positive electrical ground connection between the tongue 3 and the mounting rail 16 is obtained. This facilitates a line contact segment that has a high current transmission capability in cooperation with a mounting rail 16.

FIG. 4 illustrates that the spring contact portion 12 is in linear contact with the width of the spring with an edge of the first rail leg 17. The second rail leg 18 lies in a line contact on the contact segment 10 of the contact loop 3. A contact is present on the entire rectangular surface of the contact segment 10 with the rectangular surface of the second rail leg 18, which results in a high current transmission cross-section.

The invention is not confined to the above-described exemplary embodiments. It can be modified in the context of the attached claims. For example, the mounting rail can also have another profile. It is also possible to make the contact segment 10 wider than the base segment 4. Spring 11 can be arranged and stressed in some other way.

Figure 6:
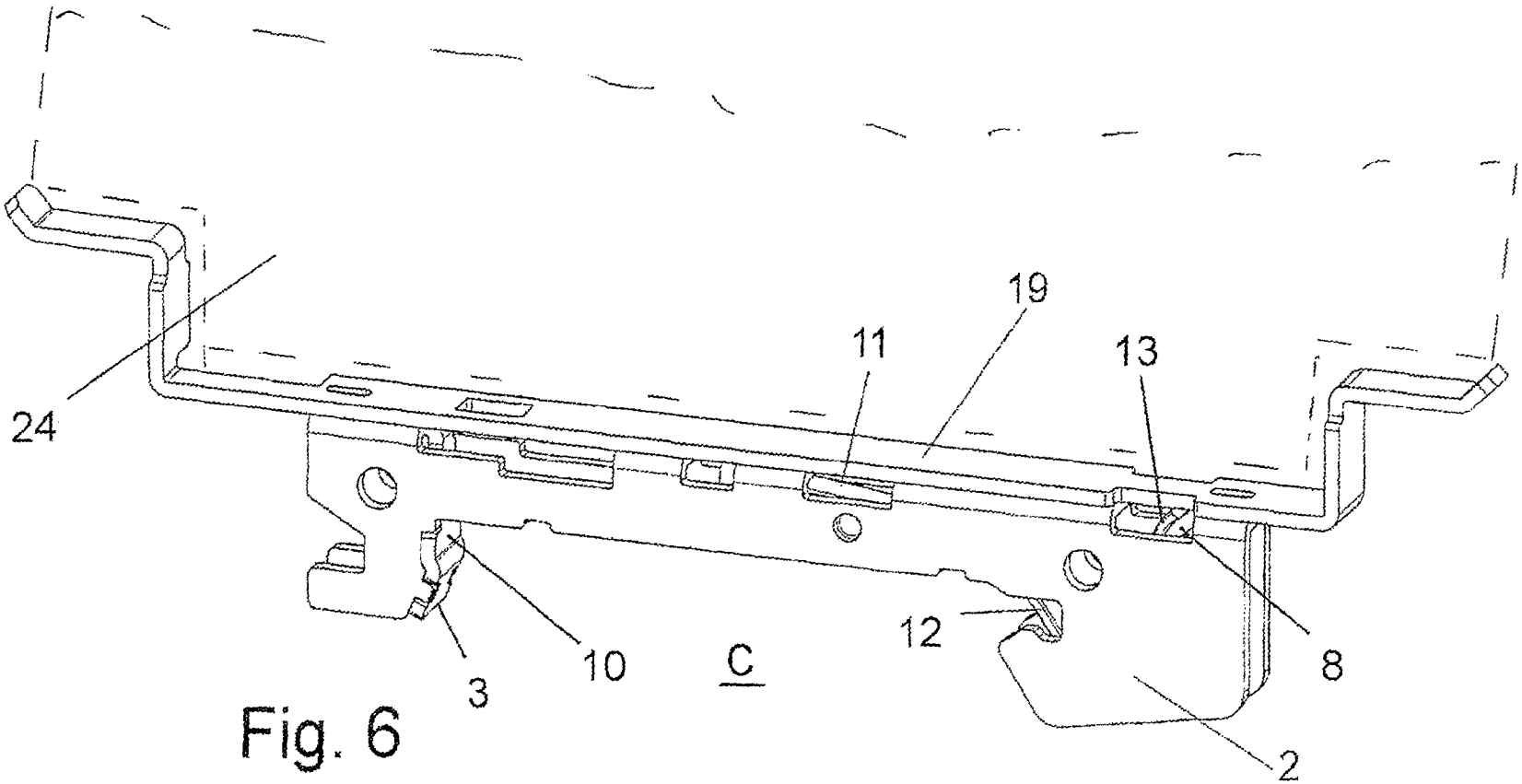
FIG. 6 is a perspective view of a modification of the ground conductor of FIG. 1.

FIG. 6 discloses a bus bar conductor connection 19 is made on the basic conductor body 2. In this way, one can in a simple way provide a conductor connection plane that, for example, can be made directly on the basic body 2 as a punch bending contour or in some other way, for example, as a soldering, riveting, embossing or welding connection. According to FIG. 6, the conductor connection is made as bus bar 19 that is arranged in a conducting manner on basic body 2 or that is connected with it integrally, thereby to connect to ground the circuits of the electrical component 24.

While in accordance with the provisions of the Patent Statutes the preferred forms and embodiments of the invention have been illustrated and described, it will be apparent to those skilled in the art that changes may be made without deviating from the invention described above.

What is claimed is:

1. A ground conductor (1) for connecting an electrical component (22) with a mounting rail (16) having a generally U-shaped top-hat configuration including a pair of oppositely outwardly-directed horizontal flange portions (17, 18), comprising:

(a) a conductor body (2) formed from a sheet of conductive metal material and having an inverted U-shaped configuration including:

(1) a horizontal base portion (4); and (2) a pair of vertical leg portions (5 and 6) extending downwardly from said base portion, said leg portions having lower edge portions containing corresponding opposed mounting rail cavities (C), respectively;

(3) said mounting rail cavities (C) having first ends containing a pair of flange recesses (9), respectively, said rail cavities having second ends;

(4) said conductor body further including a conductive vertical tongue portion (3) extending transversely across said conductor body leg portions at said mounting rail cavity second ends, said tongue portion having a width (w) that is greater than the thickness (t) of said conductive metal sheet, whereby when said conductor body is mounted transversely across the mounting rail with the mounting rail extending within said mounting rail cavities, a first one of the mounting rail flange portions extends into said pair of flange recesses at said cavity first ends, the second one of the mounting rail flange portions having a free extremity that terminates adjacent said vertical tongue portion; and (b) spring means (11) for biasing said conductor body relative to the mounting rail in a direction to effect electrical engagement between the second mounting rail flange extremity and said conductor body vertical tongue portion.

2. A ground conductor as defined in claim 1, wherein said conductive tongue portion (3) is punched out of and bent downwardly from said conductor body base portion.

3. A ground conductor as defined in claim 2, wherein said conductive tongue portion includes side surfaces that contain opposed slots for receiving corresponding stabilizing tabs (5a, 6a) extending outwardly from said conductor body leg portions.

4. A ground conductor as defined in claim 2, wherein said spring means comprises a leaf spring (11) mounted between said conductor body leg portions.

5. A ground conductor as defined in claim 4, wherein said leaf spring includes a pair of end support portions (13, 15) supported by said conductor body base portion, and a reversely bent intermediate portion (14), said leaf spring being in a compressed condition such that a section (12) of said spring intermediate portion extends within said flange recesses for engagement with the associated mounting rail flange portion.

6. A ground conductor as defined in claim 5, and further including a conductive bus bar (19) extending parallel to and connected with said conductor body base portion.

7. A ground conductor (1) assembly for grounding an electrical component (22, 24) with a mounting rail (16), comprising:

(a) a conductive mounting rail having a generally U-shaped top-hat configuration including a pair of oppositely outwardly-directed horizontal flange portions (17, 18);

(b) a conductor body (2) formed from a sheet of conductive metal material and having a generally inverted U-shaped configuration including:

(1) a horizontal base portion (4); and (2) a pair of vertical leg portions (5 and 6) extending downwardly from said base portion, said leg portions having lower edge portions containing corresponding opposed mounting rail cavities (C), respectively;

(3) said mounting rail cavities (C) having first ends containing a pair of flange recesses (9), respectively, said rail cavities having second ends;

(4) said conductor body further including a conductive vertical tongue portion (3) extending transversely across said conductor body leg portions at said mounting rail cavity second ends, said tongue portion having a width (w) that is greater than the thickness (t) of said conductive metal sheet, whereby when said conductor body is mounted transversely across the mounting rail with the mounting rail extending within said mounting rail cavities, a first one of said mounting rail flange portions extends into said pair of flange recesses at said cavity first ends, the second one of said mounting rail flange portions having a free extremity that terminates adjacent said vertical tongue portion; and (c) spring means (11) for biasing said conductor body relative to the mounting rail in a direction to effect electrical engagement between said second mounting rail flange extremity and said conductor body vertical tongue portion, said spring means comprising a leaf spring (11) mounted between said conductor body leg portions.

* * * * *